US006286485B1

(12) United States Patent
Felton

(10) Patent No.: US 6,286,485 B1
(45) Date of Patent: Sep. 11, 2001

(54) DISTRIBUTOR ARRANGEMENT

(75) Inventor: George Nicholas Felton, Gillingham (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/357,597

(22) Filed: Jul. 20, 1999

(30) Foreign Application Priority Data

Aug. 4, 1998 (GB) ..... 9816926

(51) Int. Cl.[7] ..... F02M 41/00
(52) U.S. Cl. ..... 123/450; 123/41.31; 417/462
(58) Field of Search ..... 123/450, 41.31, 123/541; 417/540, 462

(56) References Cited

U.S. PATENT DOCUMENTS 5,619,971 * 4/1997 Kubo et al. ..... 123/450
5,782,620 * 7/1998 Nothdurft et al. ..... 417/462
5,806,493 * 9/1998 Kubo et al. ..... 123/450
6,058,910 * 5/2000 Simmons et al. ..... 123/450
6,059,547 * 5/2000 Konishi et al. ..... 417/540

FOREIGN PATENT DOCUMENTS 0604084 6/1994 (EP) .
02104964 4/1990 (JP) .

* cited by examiner

*Primary Examiner*—Carl S. Miller
(74) *Attorney, Agent, or Firm*—Andrus, Sceales, Starke & Sawall

(57) ABSTRACT

A distributor arrangement is disclosed which comprises a distributor member rotatable within a bore formed in a sleeve, the sleeve being provided with a supply port through which fuel under high pressure can be supplied to the distributor member, in use, and a plurality of delivery ports, the distributor member being provided with a delivery passage registrable with the delivery ports, in turn, upon rotation of the distributor member whereby fuel under pressure supplied through the supply port flows to a selected one of the delivery ports, in use, the distributor arrangement further comprising a porting arrangement whereby, when the distributor member occupies a position in which the delivery passage is not registered with any of the delivery ports, cooling fluid is able to flow through the delivery passage.

12 Claims, 2 Drawing Sheets

DISTRIBUTOR ARRANGEMENT

Figure 1:
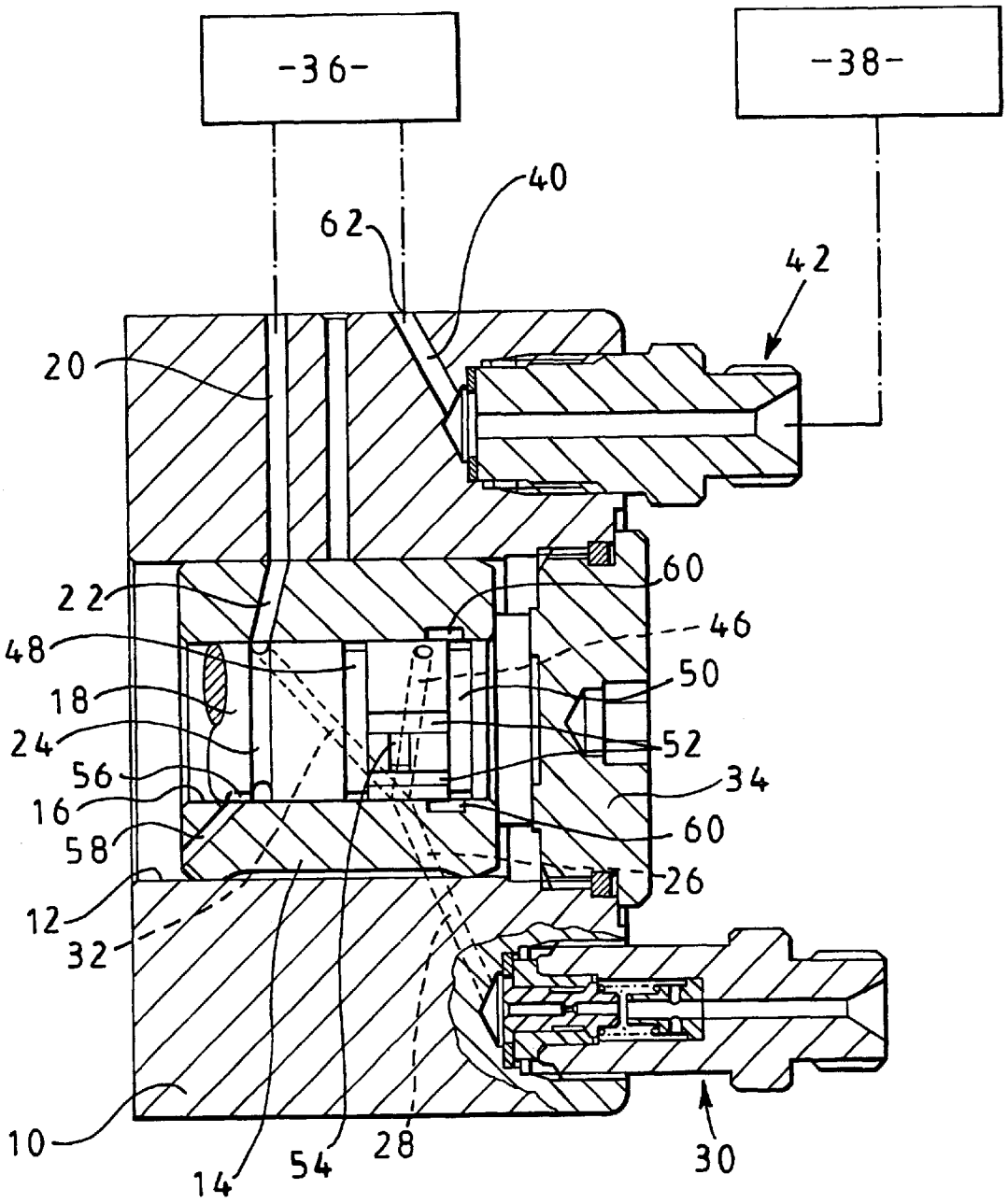

This invention relates to a distributor arrangement for use in the distribution of fuel under high pressure to injection equipment used for delivering the fuel to the cylinders of a compression ignition internal combustion engine.

In a known fuel system, a high pressure fuel pump receives fuel at a relatively low pressure from a low pressure, transfer pump, the high pressure fuel pump being used to charge an accumulator with fuel to a high pressure. A distributor arrangement is connected to an outlet of the accumulator through an appropriate control valve which is used to control the timing of fuel delivery and the quantity of fuel to be delivered.

The distributor arrangement comprises a distributor member which is rotatable within a sleeve at a speed associated with the operating speed of an associated engine. The distributor member and the sleeve are provided with appropriate passages and ports such that, shortly before delivery is to commence through a particular injector, the passages and ports of the distributor arrangement register with one another to define a flow path between a port of the control valve and the chosen injector. Once such communication has been established, fuel delivery through that injector is controlled by the control valve. After termination of injection, the rotation of the distributor member results in the communication between the control valve and the chosen injector being broken, and subsequently in communication being established between the control valve and the next injector ready for the next injection cycle to take place.

In order to restrict leakage of fuel from the distributor arrangement to an acceptable level, the clearance between the distributor member and the sleeve is very small. As a result, thermal expansion of the distributor member, in use, may result in the distributor arrangement becoming seized, and it is an object of the invention to provide a distributor arrangement in which the risk of seizure due to thermal expansion is reduced.

According to the present invention there is provided a distributor arrangement comprising a distributor member rotatable within a bore formed in a sleeve, the sleeve being provided with a supply port through which fuel under high pressure can be supplied to the distributor member, in use, and a plurality of delivery ports, the distributor member being provided with a delivery passage registrable with the delivery ports, in turn, upon rotation of the distributor member whereby fuel under pressure supplied through the supply port flows to a selected one of the delivery ports, in use, the distributor arrangement further comprising a porting arrangement whereby, when the distributor member occupies a position in which the delivery passage is not registered with any of the delivery ports, cooling fluid is able to flow through the delivery passage.

It will be appreciated that, in such an arrangement, cooling of the distributor member is possible between injections, and as a result thermal expansion of the distributor member can be controlled and the risk of seizure is reduced.

The cooling fluid conveniently takes the form of relatively cool fuel at low pressure supplied to the distributor arrangement by a transfer pump.

Figure 2:
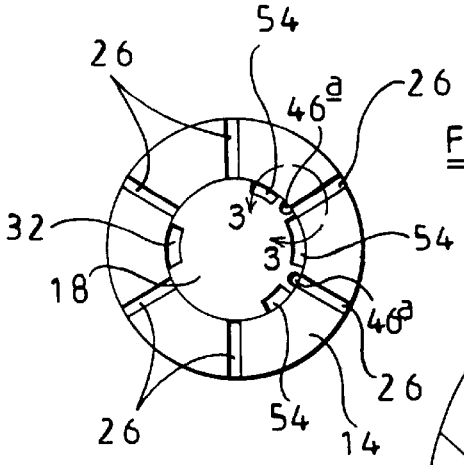
Figure 3:
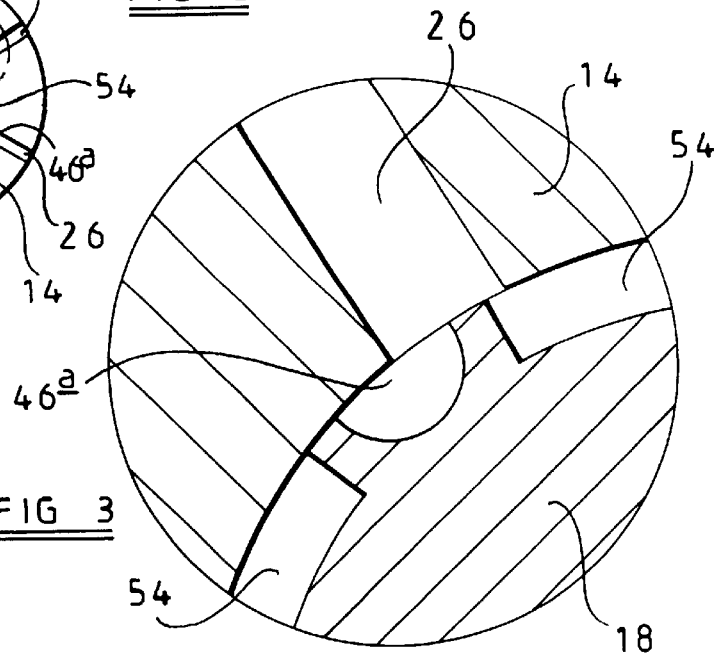
Figure 4:
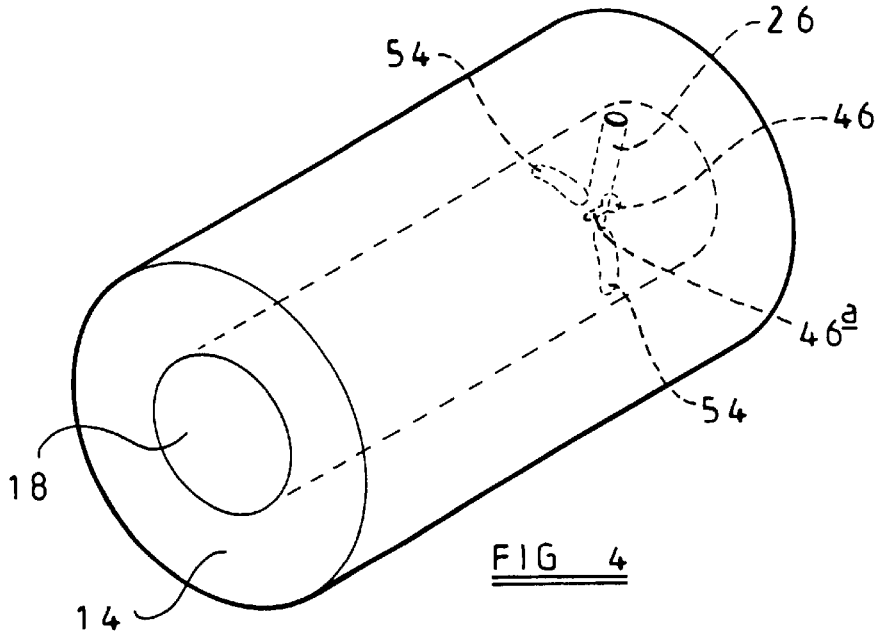

The invention will further be described, by way of example, with reference to the accompanying drawings, in which:

FIG. 1 is a sectional view illustrating a distributor arrangement in accordance with an embodiment of the invention; and FIGS. 2, 3 and 4 illustrate a modification to the arrangement of FIG. 1.

The distributor arrangement illustrated in FIG. 1 comprises a housing 10 provided with a relatively large diameter bore 12 within which a sleeve member 14 is located. The housing 10 and sleeve member 14 are conveniently assembled using a thermal expansion technique. An open end of the bore 12 of the housing 10 is closed by an externally screw threaded plug 34 arranged to cooperate with a corresponding screw thread provided within the bore 12 of the housing 10. A passage 62 is provided in the housing 10 which permits drainage of any fuel leaking between the housing 10 and the sleeve member 14.

The sleeve member 14 is provided with an axially extending bore 16. A distributor member 18 extends within the bore 16 of the sleeve member 14. The distributor member 18 is arranged to be rotated at a speed associated with the speed of operation of an associated compression ignition internal combustion engine.

The housing 10 is provided with a passage 20 which communicates, through a control valve 36, which controls the timing of injection and the quantity of fuel to be injected, with an accumulator 38. For convenience, the accumulator 38 and control valve 36 communicate with one another through a passage 40 provided in the housing 10 and a connector member 42 secured to the housing 10. In use, the accumulator is charged to a high pressure with fuel supplied to the accumulator by an appropriate high pressure fuel pump.

The passage 20 communicates with a supply port 22 provided in the sleeve member 14, the supply port 22 communicating, in turn, with a first annular groove 24 provided in the distributor member 18.

The sleeve member 14 is further provided with four equiangularly spaced delivery ports 26 (only one of which is shown) which communicate through respective passages 28 provided in the housing 10 with delivery valves 30 located within outlet ports of the housing 10. In use, high pressure fuel pipes are connected to the delivery valves 30 for use in carrying fuel under high pressure to the injectors associated with each cylinder of the engine.

The distributor member 18 is provided with a delivery passage 32 which communicates with the first annular groove 24 and which opens to the exterior of the distributor member 18 at a position axially aligned with the delivery ports 26 such that, upon rotation of the distributor member 18 relative to the sleeve member 14, the delivery passage 32 registers with each of the delivery ports 26, in turn. The delivery passage 32 communicates with a pressure balancing passage 46 which opens to the exterior of the distributor member 18 at a position opposite and axially spaced from the position at which the delivery passage 32 opens to the exterior of the distributor member 18.

As shown in FIG. 1, the distributor member is provided with second and third annular grooves 48, 50, the annular grooves 48, 50 being interconnected by connecting grooves 52 extending in the axial direction of the distributor member, some of the grooves 52 being further interconnected by arcuate grooves 54 which are positioned so as to be registrable with the delivery ports 26, upon rotation of the distributor member 18. The second and third annular grooves 48, 50, the arcuate grooves 54 and the connecting grooves 52 communicate through a passage (not shown) with the outlet of a low pressure, transfer pump.

The distributor member 18 is provided with a drain port 56 which opens into the first annular groove 24, the drain port 56 being registrable, upon rotation of the distributor member 18, with a series of drain passages 58 provided in the sleeve member 14. The drain passages 58 are positioned such that registration between the drain port 56 and the drain passages 58 only occurs when the delivery passage 32 is not registered with any of the delivery ports 26. The drain passages 58 communicate with the bore 12 of the housing 10 which, in use, communicates with a low pressure fuel reservoir.

The sleeve member 14 is further provided with a series of connection ports 60. The connection ports 60 are in constant communication with the third annular groove 50, and are positioned such that, upon rotation of the distributor member 18, the pressure balancing passage 46 registers with the connection ports 60, in turn, registration between the pressure balancing passage 46 and the connection ports 60 only occurring when the delivery passage 32 is not registered with any of the delivery ports 26.

In use, starting from a position in which the delivery passage 32 registers with one of the delivery ports 26, when it is determined that injection of fuel through the injector connected to that delivery port 26 is to commence the control valve 36 is switched to permit fuel at high pressure to be supplied from the accumulator 38 through the control valve 36 to the passage 20 and supply port 22. The fuel flows through the first annular groove 24 and delivery passage 32 to the delivery port 26, and from there to the injector. The injector is therefore supplied with fuel at high pressure, the pressure being sufficiently high to cause the injector to open, thus delivering fuel to the associated cylinder of the engine.

Fuel under high pressure is also supplied to the pressure balancing passage 46. At this stage in the operating cycle of the distributor arrangement, the pressure balancing passage 46 is closed, and the application of fuel under pressure thereto serves to assist in balancing the distributor member 18, compensating for the side loading applied thereto by the fuel under pressure supplied to the delivery passage 32.

As mentioned hereinbefore, at this stage in the operation of the distributor arrangement, the pressure balancing passage 46 is closed, thus fuel at high pressure is unable to flow to the connection ports 60 or to the third annular groove 50. The drain port 56 is also closed so fuel is unable to escape to the low pressure fuel reservoir through the drain port 56 and drain passages 58.

When injection is to terminate, the control valve 36 is switched to break the communication between the accumulator 38 and the injector, and instead the control valve 36 connects the passage 20 to a low pressure fuel reservoir. As a result, the fuel pressure applied to the injector falls rapidly, and injection terminates.

The distributor member 18 is arranged to rotate at a speed associated with engine speed, and the various ports and passages are of dimensions sufficient to ensure that the communication between the control valve and the injector is maintained throughout the period during which injection is to occur.

After termination of injection, the continued movement of the distributor member results in the communication between the delivery passage 32 and the delivery port 26 being broken, and subsequently in the drain port 56 registering with one of the drain passages 58, and in the pressure balancing passage 46 registering with one of the connection ports 60. Once such a position is achieved, fuel at transfer pressure from the third annular groove 50 is able to flow through the said one of the connection ports 60 to the pressure balancing passage 46, and through the delivery passage 32 to the first annular groove 24. From the first annular groove 24, the fuel flows through the drain port 56 and adjacent drain passage 58 to the bore 12 and is returned to a low pressure fuel reservoir.

The flow of low pressure, relatively cool fuel through the distributor member 18 serves to cool the distributor member, thus reducing the level of thermal expansion which occurs, in use, and hence reducing the risk of seizure of the distributor arrangement.

The continued rotation of the distributor member subsequently breaks the communication between the drain port 56 and adjacent drain passage 58, and breaks the communication between the pressure balancing passage 46 and connection port 60, the distributor member 18 subsequently reaching a position in which the delivery passage 32 registers with the delivery port 26 associated with the next injector, ready for the commencement of the next injection cycle.

The network of connecting grooves 52 and arcuate grooves 54 serve to ensure that, during operation of the distributor arrangement, some of the delivery ports 26 other than that through which fuel is being delivered at any particular time, are connected to transfer pressure, thus pressurising the fuel pipes connected thereto to a predetermined, relatively low pressure.

In the arrangement described hereinbefore, the presence of a single pressure balancing passage 46 is described. It will be appreciated that two or more such passages may be provided, if desired, the passages being located to ensure that the distributor member is pressure balanced and to register with the connection ports at appropriate points in the operation of the distributor arrangement.

Although the description hereinbefore is of an arrangement suitable for use in supplying fuel to a four cylinder engine, it will be appreciated that the invention is also applicable to distributor arrangements suitable for use in other applications, for example arrangements in which fuel is to be delivered to a six cylinder engine as shown in FIGS. 2, 3 and 4. The invention is also applicable to a distributor arrangement forming part of a rotary distributor fuel pump.

In a modification, the drain port(s) 56 and passages(s) 58 may be omitted and the cooling fluid flow be routed to a low pressure reservoir through the supply port 22, passage 20 and control valve 36. Such an arrangement is advantageous in that manufacture is simplified as some machining operations are omitted. Further, the cooling effect is improved as the passage 20 and feed port 22 are cooled and a subsequent supply of fuel to the distributor member is cooler than it would otherwise be.

FIGS. 2, 3 and 4 illustrate, diagrammatically, an arrangement for delivering fuel to a six cylinder engine which is further modified to avoid the provision of certain of the ports. In the modification of FIGS. 2, 3 and 4, the connection ports 60 are omitted, and instead the delivery ports 26 are used to provide a connection between the pressure balancing passage 46 and grooves provided in the distributor member 18 which are connected to the outlet of the transfer pump. As illustrated, the grooves to which the pressure balancing passage 46 can be connected are the arcuate grooves 54 used for connecting some of the injectors through which fuel is not being supplied with fuel at transfer pressure. The open end of the pressure balancing passage 46 is conveniently of "key-hole" shape, the narrower part 46*a* of the open end of the pressure balancing passage 46 being axially aligned with the arcuate grooves 54 and located such that, during rotation of the distributor member, a period exists during which the arcuate grooves 54 communicates through the ends of the delivery ports 26 with the pressure balancing passage 46, as illustrated in FIGS. 3 and 4.

The open end of the pressure balancing passage 46 need not be of "key-hole" shape to achieve the effect described hereinbefore and may, for example, be of "tear drop" shape. Similarly, the shape of the ends of the arcuate grooves 54 may be modified.

Clearly, in the arrangement of FIGS. 2, 3 and 4, the pressure balancing passage 46 cannot open onto the side of the distributor member 18 immediately opposite the delivery passage 32 as such positioning may result in fuel delivery to two injectors at the same instant. In order to balance the distributor member 18 and avoid such dual injection, the distributor member 18 is conveniently provided with two or more such pressure balancing passages 46 in appropriate positions as described hereinbefore.

What is claimed is:

1. A distributor arrangement comprising a distributor member rotatable within a bore formed in a sleeve, the sleeve being provided with a supply port through which fuel under high pressure can be supplied to the distributor member, in use, and a plurality of delivery ports, the distributor member being provided with a delivery passage registrable with the delivery ports, in turn, upon rotation of the distributor member whereby fuel under pressure supplied through the supply port flows to a selected one of the delivery ports in use, the distributor arrangement further comprising a porting arrangement whereby, when the distributor member occupies a position in which the delivery passage is not registered with any of the delivery ports, cooling fluid is able to flow through the delivery passage, wherein cooling fluid is also able to flow through other passages in the distributor member, and wherein the other passages include at least one annular groove formed in the distributor member.

2. A distributor arrangement comprising a distributor member rotatable within a bore formed in a sleeve, the sleeve being provided with a supply port through which fuel under high pressure can be supplied to the distributor member, in use, and a plurality of delivery ports, the distributor member being provided with a delivery passage registrable with the delivery ports, in turn, upon rotation of the distributor member whereby fuel under pressure supplied through the supply port flows to a selected one of the delivery ports in use, the distributor arrangement further comprising a porting arrangement whereby, when the distributor member occupies a position in which the delivery passage is not registered with any of the delivery ports, cooling fluid is able to flow through the delivery passage, wherein the porting arrangement includes a pair of recesses formed in the distributor member, communication between the recesses being permitted when the recesses both register with one of the delivery ports.

3. The distributor arrangement as claimed in claim 2, further comprising at least one further recess.

4. A distributor arrangement comprising a distributor member rotatable within a bore formed in a sleeve, the sleeve being provided with a supply port through which fuel under high pressure can be supplied to the distributor member, in use, and a plurality of delivery ports through which the fuel under high pressure is delivered to an associated engine, the distributor member being provided with a delivery passage registrable with the delivery ports, in turn, upon rotation of the distributor member whereby fuel under pressure supplied through the supply port flows to a selected one of the delivery ports in use, the distributor arrangement further comprising a porting arrangement arranged to communicate with the delivery ports when the distributor member occupies a position in which the delivery passage is not registered with any of the delivery ports such that cooling fluid is able to flow through the delivery passage.

5. The distributor arrangement as claimed in claim 1, wherein the cooling fluid comprises relatively cool fuel.

6. The distributor arrangement as claimed in claim 1, wherein cooling fluid is also able to flow through other passages provided in the distributor member.

7. The distributor arrangement as claimed in claim 6, wherein the other passages include at least one annular groove formed in the distributor member.

8. The distributor arrangement as claimed in claim 1, further comprising an arrangement whereby fuel at low pressure is applied to at least one of the delivery ports.

9. The distributor arrangement as claimed in claim 1, wherein the porting arrangement includes a plurality of connection ports provided in the sleeve.

10. The distributor arrangement as claimed in claim 1, wherein the porting arrangement includes a pair of recesses formed in the distributor member, communication between the recesses being permitted when the recesses both register with one of the delivery ports.

11. The distributor arrangement as claimed in claim 10, further comprising at least one further recess.

12. The distributor arrangement as claimed in claim 1, wherein the porting arrangement is defined, in part, by a pressure balancing passage provided in the distributor member.

* * * * *